US006658980B1

(12) United States Patent
Hayes et al.

(10) Patent No.: US 6,658,980 B1
(45) **Date of Patent: *Dec. 9, 2003**

(54) COMBAT PILOT AID SYSTEM

(75) Inventors: Johnathan Hayes, Warton (GB); Terence Prendergast, Warton (GB)

(73) Assignee: British Aerospace Public Limited Co., Farnborough (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/499,308

(22) Filed: Feb. 7, 2000

Related U.S. Application Data

(63) Continuation of application No. PCT/GB99/04173, filed on Dec. 10, 1999.

(30) Foreign Application Priority Data

Dec. 12, 1998 (GB) ..... 9827358

(51) Int. Cl.[7] ..... G06N 3/02
(52) U.S. Cl. ..... 89/1.11; 706/24
(58) Field of Search ..... 89/41.21, 1.11; 706/15, 16, 17, 20, 22, 23, 24

(56) References Cited

U.S. PATENT DOCUMENTS 5,155,801 A * 10/1992 Lincoln ..... 706/20
5,222,065 A * 6/1993 Krogmann
5,247,584 A * 9/1993 Krogmann
5,259,064 A * 11/1993 Furuta et al.
6,169,981 B1 * 1/2001 Werbos
6,542,879 B2 * 4/2003 Biggers et al. ..... 706/24

FOREIGN PATENT DOCUMENTS

| | | | |
|---|---|---|---|
| DE | 4240789 | A1 * | 12/1992 |
| DE | 4218599 | A1 * | 12/1993 |
| DE | 4218600 | A1 * | 12/1993 |
| DE | 19645556 | A1 * | 10/1997 |
| DE | 19832612 | A1 * | 7/1998 |
| DE | 0974806 | A1 * | 1/2000 |
| DE | 19857894 | A1 * | 6/2000 |
| EP | 0531712 | A2 * | 8/1992 |
| EP | 0654776 | A2 * | 5/1995 |

* cited by examiner

*Primary Examiner*—Michael J. Carone
*Assistant Examiner*—Troy Chambers
(74) *Attorney, Agent, or Firm*—Pillsbury Winthrop LLP

(57) ABSTRACT

A combat pilot system for an aircraft comprises corresponding combat pilot devices 12, 12' provided in a runtime module 14 on board the aircraft and a ground-based system training module 16 respectively. The run-time module 12' is trained using model data generated simulation model 18 as well as feedback data from actual missile firings. The matrix of weights derived from the training routines are then programmed into the neural network in the corresponding combat pilot aid system 12 on board the aircraft so that the runtime module is capable of processing the input data producing the four parameters required for launch of a missile and also a FIRE/NO FIRE indication to the pilot.

10 Claims, 1 Drawing Sheet

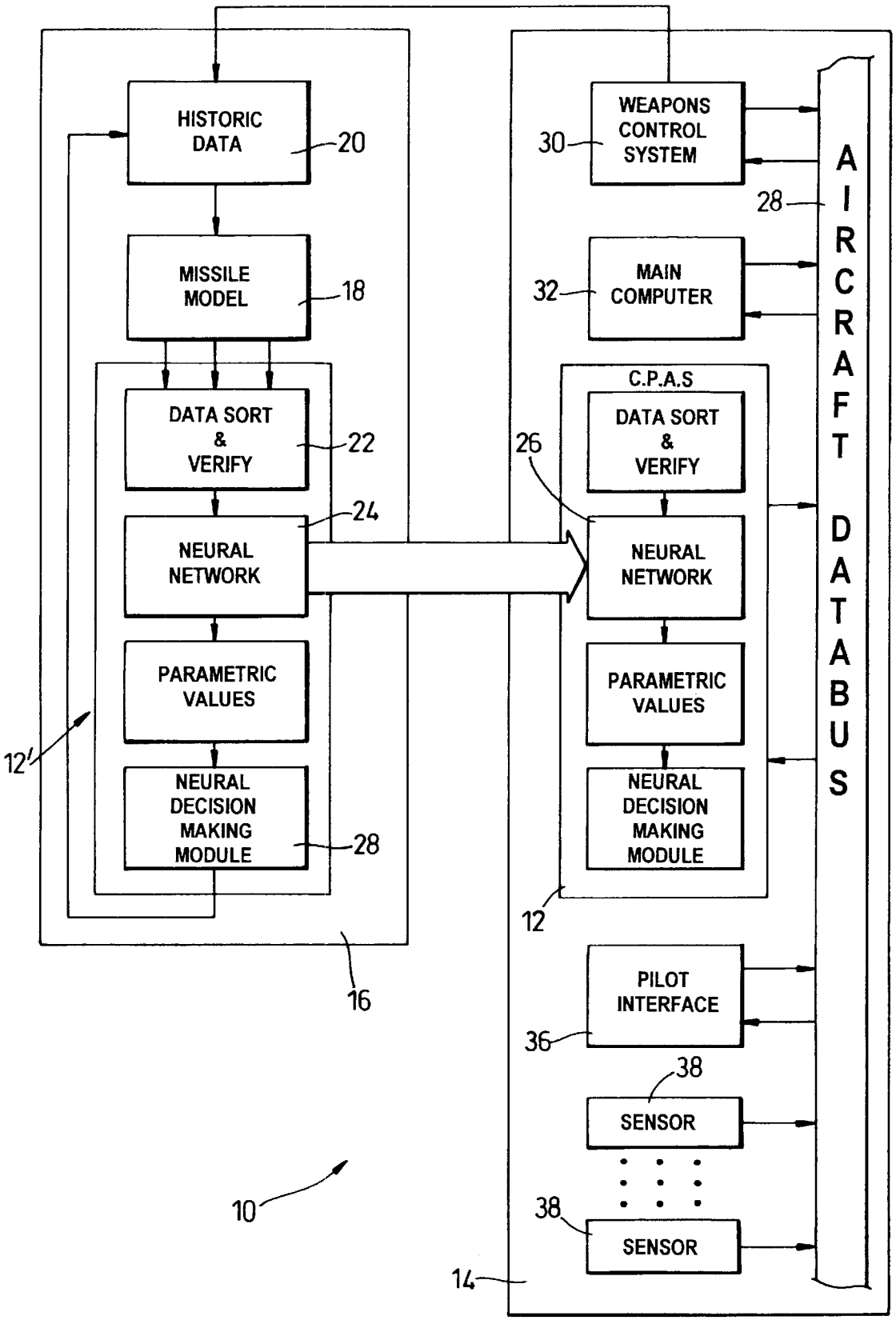
HISTORIC DATA
20
MISSILE MODEL
18
DATA SORT & VERIFY
22
NEURAL NETWORK
24
PARAMETRIC VALUES
NEURAL DECISION MAKING MODULE
28
12'
16
WEAPONS CONTROL SYSTEM
30
28
MAIN COMPUTER
32
C.P.A.S
DATA SORT & VERIFY
26
NEURAL NETWORK
PARAMETRIC VALUES
NEURAL DECISION MAKING MODULE
12
PILOT INTERFACE
36
38
SENSOR
38
SENSOR
14
AIRCRAFT DATABUS
10

COMBAT PILOT AID SYSTEM

This is a continuation of International Appln. No. PCT/GB99/04173 filed Dec. 10, 1999.

This invention relates to a Combat Aid System for processing input data to derive data useful prior to or during deployment of a missile, to apparatus for use in such systems, and to methods implemented in such systems. In particular, but not exclusively, the invention is concerned with such systems, apparatus and methods for use on board an aircraft.

Modern combat aircraft are equipped with a wide range of active and passive defence or attack systems such as missiles, electronic counter-measures, etc., and there is a considerable amount of information available to the pilot. For example there is the usual information provided by the flight computer relating to the flight parameters and operating conditions of the aircraft; intelligence information relating to potential targets; data identifying the characteristics and performance of the missiles on board the aircraft, radar and infra-red images of potential targets, and much more. For execution of a successful mission, any system which lightens the pilot's workload in assessing and using this broad range of data is highly desirable.

In particular, it is extremely important to be able to calculate or predict with high accuracy the four critical decision parameters needed for launch of the missile, namely $R_{max}$, $R_{min}$, $R_{no\text{-}action}$, $R_{no\text{-}escape}$. $R_{max}$ is the maximum range of missile type at present target attitude; $R_{min}$ is the minimum range of missile type at present target attitude; $R_{no\text{-}action}$ is the range at which the missile would acquire the target, but other factors prevent launch (i.e. closing rate would mean missile fusing close to launch aircraft), and $R_{no\text{-}escape}$ is the range at which the target cannot escape the launch success zone of missile.

We have developed a combat pilot aid system which assists a pilot in a combat situation by taking in data from sensors in the flight control system to return the four critical values referred to above. In the system described below, a processor on board the aircraft calculates one or more of the above parameters and is capable of periodic communication with a training module which is typically ground based and which has available model data from a model of the missile as well as historic data from firings of the particular missile or a similar missile type from the same or similar aircraft. The training module may use this data in a training routine to derive a series of training parameters for reprogramming the system on board the aircraft.

Accordingly, in one aspect, this invention provides a combat pilot aid system for an aircraft having a missile, said system including:

- a runtime module on board the aircraft, comprising a processor operable for receiving input data representing selected operating parameters of the aircraft and/or missile and to output data identifying one or more parameters relating to launch of said missile;
- a training module comprising an adaptive processor for being trained on previous or modelled data relating to said aircraft and/or the missile and/or the particular target, to learn the relationship between said input data and said output data and to adjust the programming parameters of said adaptive processor accordingly;
- means for reprogramming the processor of said runtime module in accordance with the adjusted parameters of said adaptive processor, and
- means on board said aircraft for storing data relating to a missile launch, for later use by said training module.

Preferably, the runtime module processor is a neural network. Preferably, the training module adaptive processor comprises a neural network comprising a similar topology to that of the runtime processor.

Preferably the output data of said runtime module processor identifies the four values $R_{max}$, $R_{min}$, $R_{no\text{-}action}$, and $R_{no\text{-}escape}$ Preferably said runtime module additionally provides output data indicating whether the pilot should fire the missile.

Preferably the training module comprises a model representing the performance of the missile. Preferably the training module further comprises means for storing historic data relating to previous firings of the missile or similar from the aircraft or similar.

Preferably the runtime module includes means for deriving and sorting data relating to an actual missile firing, for later use by said training module.

In another aspect, this invention provides a combat aid system for a missile launch or monitoring station which comprises a neural network trained with training data modelling the missile envelope, and means for inputting in use to said neural network parameters relating to the intended target, whereby said neural network provides at least some of the parameters required for launch of the missile.

In a further aspect, this invention provides a method for determining selected launch parameters for launching a missile from an aircraft, which method comprises:

- supplying selected operating parameters of the aircraft and/or missile to a runtime module on board the aircraft comprising a processor which has been previously trained to output data identifying one or more parameters relating to launch of said missile,
- providing a training module comprising an adaptive processor trained on previous or modelled data relating to the aircraft and/or missile and/or missile target to learn the relationship between said input data and said output data and to adjust the programming parameters of said adaptive processor accordingly, using said adjusted programming parameters to reprogram said runtime module processor, and
- storing on board said aircraft data relating to a missile launch for later use by said training module.

Whilst the invention has been described above, it extends to any inventive combination of the features set out above or in the following description.

The invention may be performed in various ways, and an embodiment thereof will now be described in detail, reference being made to the accompanying drawings, in which:

FIG. 1 is a block diagram of a combat pilot aid in accordance with the invention.

Referring to the Figure, the combat pilot aid 10 comprises corresponding combat pilot aid devices 12, 12' provided in a runtime module 14 on board the aircraft and a ground-based system training module 16 respectively. The ground-based system training module 16 will typically download data from and provide re-programming coefficients for the runtime modules 14 of a group of aircraft in a similar environment.

The runtime module 14 on board the aircraft processes data from various sensors on board the aircraft and from the flight control system and applies them to the input of a processor comprising a neural network 26 implementing a radial basis function, to provide the four critical values $R_{max}$, $R_{min}$, $R_{no\text{-}action}$, $R_{no\text{-}escape}$ for launch of an air-to-air missile. In addition to providing this information, the output of the neural network is also supplied to a decision algorithm 28 which provides a FIRE/DON'T FIRE decision and displays it to the pilot.

The neural network is a multi-layer perceptron, using radial basis functions in the hidden units. The input data is pre-processed using a-priori knowledge of missile launch success zones. In one example, the minimum number of inputs for which consistent results were obtained was six, four of which are described above, the other two being unique to the application. The number of inputs (and hidden units) can be increased, but this leads to sub-optimal performance for this particular application. For other applications which have different design drivers the configuration of the neural network may vary.

The ground-based training module 16 is operable to teach the associated combat pilot aid device 12' using missile model data generated by a simulation model 18, as well as feedback data from actual missile firings recovered from the weapons control system 30 on board the aircraft and stored in a historic data store 20 in the system training module 16. The simulation model 18 expresses the weapon behaviour in given situations, in terms of range, speed, altitude, aspect of target and aircraft, each normalised to radial basis functions.

The teaching data provided by the simulation model is pre-processed at 22 using a selection and dither algorithm to ensure that the data is in an optimum state for training, by refining and matching the model data for a particular type of neural network. The pre-processed data is then applied to the input layer of the training neural network 24 and the outputs applied to the outputs of the neural network 24. The matrix of weights for the neural network are determined using an error (back) propagation algorithm, or a self-organising map technique.

The neural network 24 may initially be trained using a factored set of data, either for the actual missile or one known to have similar performance, over several iterations.

Training will teach the neural network 24 to learn the characteristics of the missile in a number of different combat scenarios. The matrix of weights for the neutral network as developed by the system training module is then loaded into the neutral network 26 of the combat pilot aid device 12 in the runtime module 14 on board the aircraft. In this example, the values $R_{max}$, $R_{min}$, $R_{no\text{-}escape}$ and $R_{no\text{-}action}$ are produced at the output of the neural network, once it has been trained. In order to train the network, groups of data files are fed into the network under the following headings:

| | |
|---|---|
| (a) Intercept Height | (b) Intercept Mach. No. |
| (c) Target Height | (d) Target Mach No. |
| (e) Attitude | (f) $R_{min}$ |

The data files may be considered as being grouped in groups of four rows of data. In each group the values of (a) to (e) are the same but for (f) each row contains one of the values of $R_{max}$, $R_{,min}$, $R_{no\text{-}escape}$ and $R_{no\text{-}action}$, so that the data files have the latter values for each set of values for (a) to (e). "Attitude" represents the angle of intercept of the boresight of the target. The relationship in a file between the value of Attitude and $R_{max}$, $R_{min}$, $R_{no\text{-}escape}$ and $R_{no\text{-}action}$ makes each row of data unique, and the data files used for training contain data for different values of Attitude.

During training, the parameters (a) to (e) are supplied to the inputs of the neural network and the respective parameters (f) supplied to the output, and the neural network weights adjusted.

In the recall or run mode, the first five parameters (a) to (e) are read from the aircraft instruments or sensors and supplied to the neural network which then provides values for $R_{max}$, $R_{min}$, $R_{no\text{-}escape}$ and $R_{no\text{-}action}$ The data files for training relate to a particular missile and model the entire missile envelope. The network when trained is therefore applicable to all missiles complying with the envelope modelled.

After each mission or at appropriate intervals, the runtime module 14 and the training module 16 are linked for data transfer so that the runtime module can download to the historic data store 20 of the system training module data referring to actual missile firings, in terms of the aircraft conditions the outcome of the firing etc. The system training module will undergo a reprogramming routine to take account of the data downloaded from the aircraft and from any other associated aircraft to generate a revised matrix of weights for the neural network 26 in the runtime module. These values are then transmitted to the runtime module and the neural network 26 reprogrammed accordingly.

The runtime module 14 aboard the aircraft includes the combat pilot aid system 12 connected to the aircraft database 28 together with the main aircraft computer 32, the weapons control system computer 34 a pilot interface 36 which provides a display for the pilot and means for inputting data and commands, as well as a number of sensors 38.

In use, when the pilot is contemplating launching a missile, he inputs a command via the pilot interface 36 and the main aircraft computer 32 then collects the inputs from the various sensors 38, the flight control system, the weapons control system 30 and supplies them as inputs to the combat pilot aid device 12 which then produces the four parameters $R_{max}$, $R_{min}$, $R_{no\text{-}action}$, $R_{no\text{-}escape}$ and supplies them to the weapons control system 30, together with an indication to the pilot via the pilot interface 36 as to whether he should launch or not launch the missile.

The combat pilot aid device makes the Fire/No Fire decision on a minimum of six parameters. The four named parameters are generic to all applications, while the other two are unique to this application. If the system makes a Fire decision then the probability of a hit is higher than that for a miss.

In this example, the combat pilot aid device makes a decision based on the situation at the time with regard to the position of the target within a launch success zone for a missile of the type employed. The magnitude of the threat is not considered, but information from other sensors could be processed into a normalised vector that may be used as an additional input representing the magnitude of the threat, thus influencing the Fire/No fire decision.

The training module is usually ground-based for several reasons. There is, a limited processing capacity on the average. The system can only operate in one mode at a time, namely training or recall. The training mode is relatively slow and time consuming.

The device may be modified, by changing the training model, for use with air to ground and ground to air missiles.

What is claimed is:

1. A combat pilot aid system constructed and arranged to be used on an aircraft with a missile for being launched against a target, including:

a runtime module on board the aircraft, said module comprising a first neural network having a set of programming parameters and operable for receiving input runtime data representing selected operating parameters of two of the aircraft, the missile, and the target, and to supply output runtime data identifying one or more range parameters relating to launch of said missile;

a training module comprising a second neural network having a set of programming parameters and being trained on training input and training output data, comprising at least one of previous or modelled data relating to the aircraft, missile and the target, to learn a relationship between said training input data and said training output data, and to adjust the programming parameters of said second neural network accordingly;

means for reprogramming the first neural network of the runtime module in accordance with the adjusted parameters of said second neural network, and means on board said aircraft for capturing and storing data relating to a missile launch, for later use by said training module.

2. A combat pilot aid system according to claim 1, wherein the output data of said runtime module processor identifies the four values $R_{max}$, $R_{min}$, $R_{no\text{-}action}$, $R_{no\text{-}escape}$.

3. A combat pilot aid system according to claim 1, further including a display for displaying output data indicating whether the pilot should fire the missile.

4. A combat pilot aid system according to claim 1, wherein the training module comprises a model representing the performance of the missile.

5. A combat pilot aid system according to claim 1, wherein the training module further comprises means for storing historic data relating to previous launches of a given missile or a similar missile from a given aircraft or similar aircraft.

6. A combat pilot aid system according to claim 1, wherein said runtime module includes means for deriving and storing data relating to an actual missile firing, for later use by said training module.

7. A method for determining one or more range parameters relating to launching a missile from an aircraft towards a target, comprising:

supplying selected operating parameters of two of said aircraft, said missile and said target to a runtime module on board, said aircraft comprising a first neural network which has been previously trained to output data identifying the one or more range parameters relating to launch of said missile, providing a training module comprising a second neural network trained on training input data and training output data comprising previous and modelled data relating to said aircraft, said missile and said target to learn the relationship between said training input data and said training output data, and to adjust the programming parameters of said second neural network accordingly, using said adjusted programming parameters of said second neural network to reprogram the first neural network in said runtime module processor, and storing on board said aircraft data relating to a missile launch for later use by said training module.

8. A combat pilot aid system according to claim 1, wherein the training module neural network comprises a similar topology to that of the runtime processor.

9. A combat pilot aid system according to claim 1, wherein said first neural network in use provides at least one of the following parameters relating to launch of the missile:

(i) the maximum range of the missile at the target attitude ($R_{max}$);

(ii) the minimum range of the missile at the target attitude ($R_{min}$);

(iii) the range at which the missile could acquire the target but other factors prevent launch ($F_{no\text{-}action}$), and (iv) the range at which the target cannot escape a launch success zone ($R_{no\text{-}escape}$).

10. A combat pilot aid system according to claim 9, wherein the input data to the first neural network comprises at least one of the following:

intercept height;

intercept speed;

target height;

target speed, and the attitude angle of intercept of the boresight of the target.

* * * * *